US005146286A

United States Patent [19]

Rees et al.

[11] Patent Number: 5,146,286

[45] Date of Patent: Sep. 8, 1992

[54] COMPACT COPY SHEET INPUT/OUTPUT APPARATUS FOR AN ELECTROPHOTOGRAPHIC PRINTING MACHINE

[75] Inventors: James D. Rees, Pittsford; Thomas Acquaviva, Penfield, both of N.Y.

[73] Assignee: Xerox Corporation, Stamford, Conn.

[21] Appl. No.: 701,949

[22] Filed: May 17, 1991

[51] Int. Cl.[5] ..... G03G 15/00; B65H 1/04; B65H 31/00

[52] U.S. Cl. ..... 355/309; 355/322; 271/31; 271/163

[58] Field of Search ..... 355/309, 321, 322, 323, 355/312; 271/3, 3.1, 4, 110, 152, 153, 163, 217; 400/625

[56] References Cited

U.S. PATENT DOCUMENTS

| | | | |
|---|---|---|---|
| 4,050,805 | 9/1977 | Hage | 271/163 Y |
| 4,083,553 | 4/1978 | Beck et al. | 271/117 X |
| 4,221,374 | 9/1980 | Koch et al. | 271/4 |
| 4,350,333 | 9/1982 | Landa | 271/217 |
| 4,473,314 | 9/1984 | Imaizumi | 400/625 |
| 4,640,502 | 2/1987 | Habich et al. | 400/625 X |
| 4,715,595 | 12/1987 | Ishigaki | 271/110 |
| 4,854,232 | 8/1989 | Oda | 101/211 |
| 4,926,220 | 5/1990 | Matysek et al. | 355/313 |

FOREIGN PATENT DOCUMENTS

| | | | |
|---|---|---|---|
| 62-88739 | 4/1987 | Japan | 355/312 |
| 62-130931 | 6/1987 | Japan | 271/3.1 |
| 1-192662 | 8/1989 | Japan | 271/3 |

*Primary Examiner*—Joan H. Pendegrass

[57] ABSTRACT

A compact machine architecture is realized by combining the functions of copy sheet feeding and stacking into one integral apparatus. The apparatus is initially completely filled with copy sheets to be moved into the transfer/fusing area of a copier/duplicator machine. A vertically translatable stacker tray is positioned above the copy sheet input and is moved downward in vertical synchronism with copy sheets being fed from the input stack. A paper feed roller, attached to the bottom of the tray, continually feeds the top sheet from the input supply. As the input sheet stack is consumed, the output (feed) copies are deposited onto the stacker tray. As operation continues the supply stack is depleted while the finished stack increases, but the overall volume occupied by the copy sheets remains the same. Since there is no "empty" volume in the apparatus, the size and cost of the unit is greatly reduced.

6 Claims, 7 Drawing Sheets

COMPACT COPY SHEET INPUT/OUTPUT APPARATUS FOR AN ELECTROPHOTOGRAPHIC PRINTING MACHINE

BACKGROUND AND MATERIAL DISCLOSURE STATEMENT

The present invention relates generally to an electrophotographic printing machine and, more particularly, to a compact apparatus for feeding copy media sheets into an image transfer zone and for receiving copy sheets from a fusing area.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas resulting in the formation of an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet, which is fed from a copy sheet input section. The toner particles are heated to permanently affix the powder image to the copy sheet. The copy sheets are then delivered to a copy sheet output station where they may be simply stacked or where further operations, such as collating, stitching, or stapling may be performed.

Commercial machine architecture, as exemplified by the machines disclosed in U.S. Pat. Nos. 4,746,111 and 4,221,379, utilize a first input station to store the copy paper and feed the individual sheets into the transfer area and a second copy sheet output station on the opposite side of the machine to receive the copy sheets bearing the transferred and fused images. These two patents are typical of the "in-line" left to right or right to left copy sheet flow. The copy sheet flow may also be "folded" where the copy sheets are returned to the same side of the machine, albeit at a different location. Such a system is shown in U.S. Pat. No. 4,942,435. For either case the copy sheet input station generally incorporates a copy sheet feed tray or the like while the copy sheet output station generally incorporates a stacker tray/sorter or the like. Each station has the common characteristic of encompassing an operational space which is only partially filled by copy sheets, the remainder of the space being vacant. For example, the total volume encompassed by a copy sheet input tray may be completely filled with sheets at full loading but as the sheet feeding operation progresses, the space occupied by the sheets progressively lessens until the sheets are completely fed out leaving an empty air space. An analogous situation is present at the copy sheet stacker tray which is empty at the start of a copy operation and which gradually fills during operation.

It will be appreciated that the copy sheet input and output stations are, from an architectural viewpoint, not optimally designed. Since the unit manufacturing cost of commercial reprographic machines is substantially influenced by the size of the machine stations, it would be advantageous to make the copy sheet input and output stations as compact as possible. It would also be desired to optimize the efficiency of the folded type of architecture. According to the present invention, these objects are realized by incorporating the input and output stations into one compact apparatus which combines both functions. The novel apparatus has a total volume which is filled with a combination of input copy sheets waiting to be fed into the transfer area of the copier and with copy sheets outputted from the fusing station. This concept is enabled by providing a variable boundary between the input and output stations. In a preferred embodiment, the variable boundary coincides with the bottom of a copy sheet stacker tray which moves in a vertical direction to advance into the area vacated by the copy sheets after they are fed out of the copy sheet supply tray. More particularly, the invention relates to an improved electrophotographic printing machine of the type in which a latent image is developed on a photoconductive member and a developed image transferred to a copy sheet and the developed image fixed at a fusing station, with successive copy sheets being supplied to said transfer station from a sheet loading station and exiting said fuser station into a sheet stacking station, whereby the improvement includes: a first, fixed surface for supporting the copy sheets being supplied to said transfer station and a second, variable surface overlying said fixed surface, said second surface being vertically movable.

DESCRIPTION OF THE INVENTION

While the present invention will hereinafter be described in connection with a preferred embodiment and method of use thereof, it will be understood that it is not intended to limit the invention to that embodiment and method of use. On the contrary, it is intended to cover all alternatives, modifications, and equivalents, as may be included within the spirit and scope of the invention as defined by the appended claims.

Figure 1:
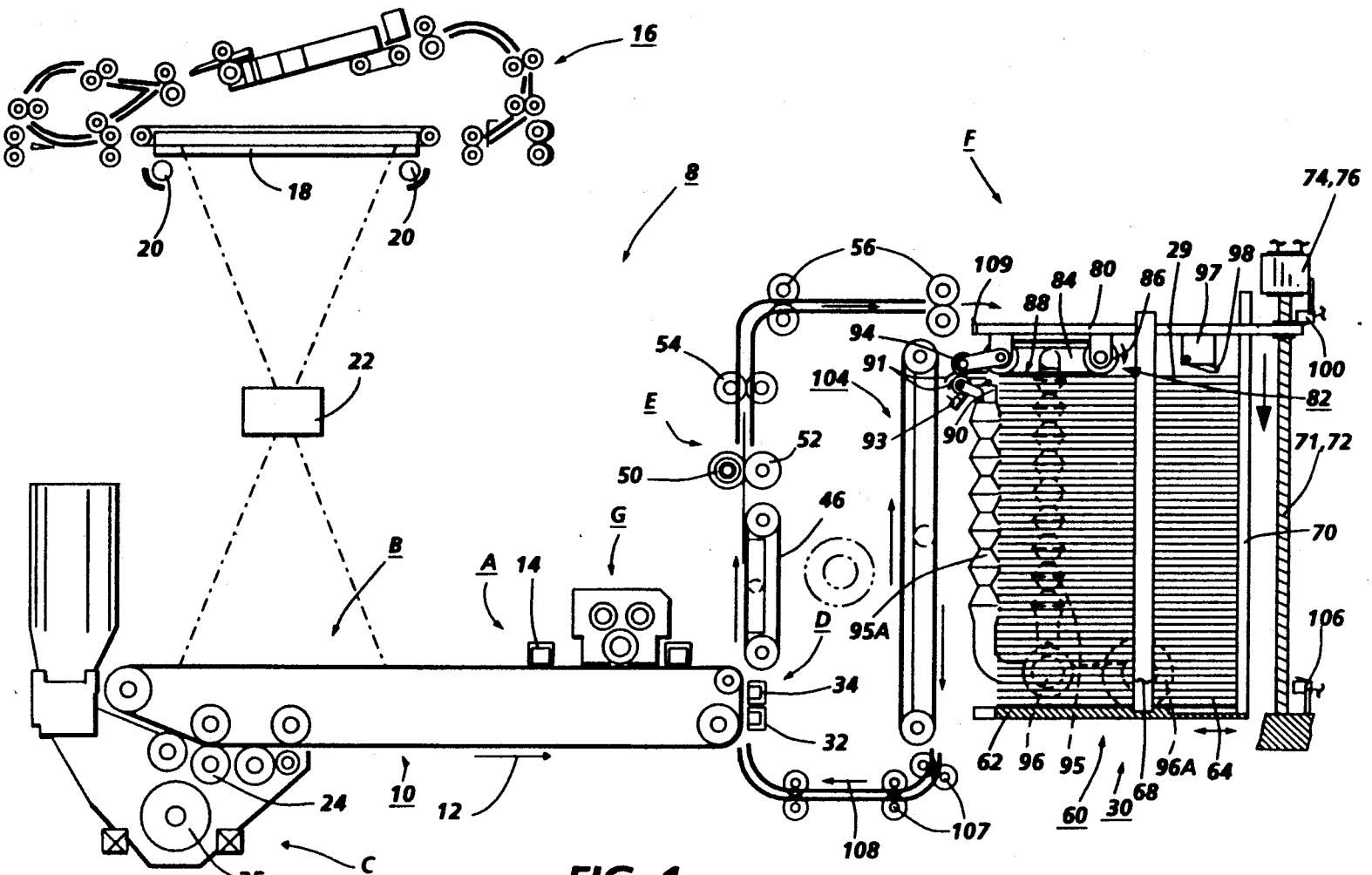
FIG. 1 is a schematic side view of an illustrative electrophotographic printing machine incorporating the compact paper input/output apparatus of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet delivery apparatus of the present invention may be employed in a wide variety of devices and is not specifically limited in its application to the particular embodiment or method of use depicted herein.

Referring to FIG. 1 of the drawings, the electrophotographic printing machine 8 employs a photoconductive belt 10. Belt 10 moves in the direction of arrow 12 to advance successive portions of the photoconductive surface of belt 10 sequentially through the various processing stations disposed about the path of movement thereof.

Initially, a portion of the photoconductive surface passes through charging station A. At charging station A, a corona generating device, indicated generally by the reference numerals 14, charges the photoconductive belt 10 to a relatively high, substantially uniform potential.

Next, the charged portion of the photoconductive surface is advanced through imaging station B. At imaging station B, a document handling unit, indicated generally by the reference numeral 16, is positioned over platen 18 of the printing machine. Document handling unit 16 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 18. After imaging, the original document is fed from platen 18 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 20 which illuminate the document on platen 18. Light rays reflected from the document are transmitted through lens 22. Lens 22 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C includes magnetic brush developer roll 24, A paddle wheel 25 picks up developer material and delivers it to the developer roll which advances developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, copy sheets 29, fed from the input station of copy sheet input/output apparatus 30, are moved into contact with the toner powder image. A detailed description of the apparatus 30 is provided below. First, photoconductive belt 10 is exposed to a pre-transfer light from a lamp (not shown) to reduce the attraction between photoconductive belt 10 and the toner powder image. Next, a corona generating device 32 charges each copy sheet to the proper magnitude and polarity so that the copy sheet is tacked to photoconductive belt 10 and the toner powder image attracted from the photoconductive belt to the copy sheet. After transfer, corona generator 34 charges the copy sheet to the opposite polarity to detack the copy sheet from belt 10. The belt surface continues to move through cleaning station G while vacuum transport conveyor 46 advances the copy sheet to fusing station E. Fusing station E includes a heated fuser roll 50 and a pressure roll 52 with the powder image on the copy sheet contacting fuser roll 50. The pressure roll is cammed against the fuser roll to provide the necessary pressure to fix the toner powder image to the copy sheet.

After fusing, the copy sheets are fed through a decurler 54. Decurler 54 bends the copy sheet in one direction to put a known curl in the copy sheet and then bends it in the opposite direction to remove that curl.

Forwarding rollers 56 then advance the sheet to the output station of input/output apparatus 30.

Figure 3:
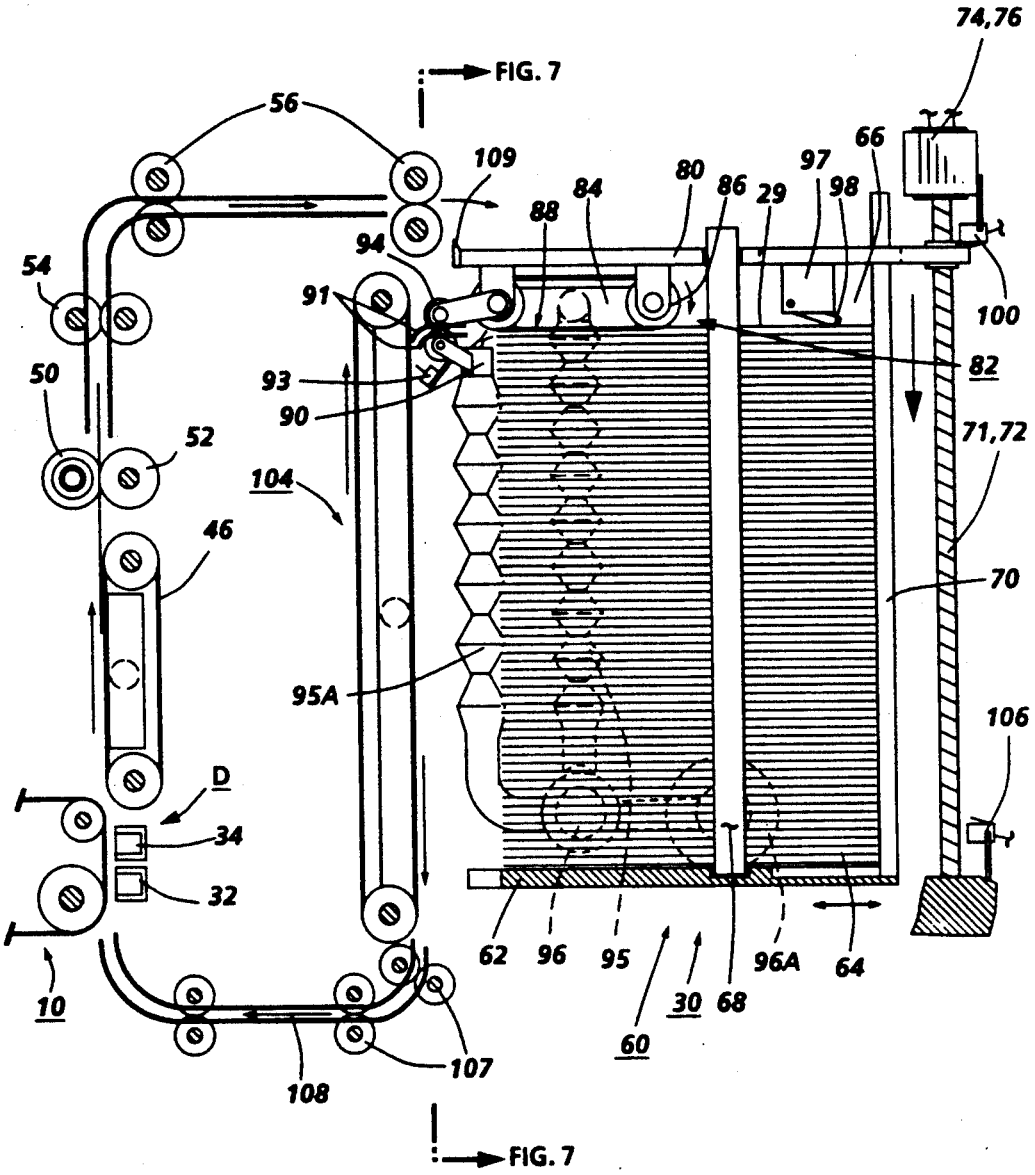
FIG. 3 is a view of the input/output apparatus of FIG. 1 in a fully loaded copy sheet input condition.

Turning now to a more detailed description of copy sheet input/output apparatus 30 and referring to FIGS. 1 and 3, the apparatus consists of a housing 60 having a bottom surface 62 which serves as a support tray for an input stack 64 of copy sheets 29, which are to be inputted into the transfer station D. The housing also incorporates fixed wall 66 and side guide 68 and front guide 70. Guides 68, 70 are movable in and out (of the page) and left to right respectively to accommodate different size copy sheets. A pair of vertically oriented machine lead screws 71, 72 (best seen in FIG. 7) are rotatedly mounted to the machine frame and are driven by stepper motors 74, 76, respectively, in a manner described below. Rotating about the shaft of the lead screws 71, 72 and adapted to be driven in a vertical direction during operation is a variable copy sheet stacker tray 80. Mounted to the bottom of tray 80 and adapted to move therewith is a vacuum copy sheet feed unit 82 comprising a vacuum plenum 84, feed roll 86, feed belt 88, air knife 90, baffle 91, take away roll sensor 93 and take away roll pair 94. An air supply from source 96 powdered by motor 96A is supplied to plenum 84 and air knife 90 via expansive bellows 95, 95A. Also mounted to the bottom of tray 80 is a height detector switch 97 having a height sensitive probe 98 contacting the top sheet of stack 64. Upper and lower limit switches 100, 106 are mounted adjacent the path of travel of the edge of tray 80 and are adapted to be energized upon contacting tray 80.

Vacuum belt 104 holds the sheet in a flat position, feeding the leading edge between roller 107 and baffle 108 until it reaches the transfer station D where the developed image is transferred to the sheet. The sheet is then carried by vacuum belt 46 through fuser station E.

Figure 2:
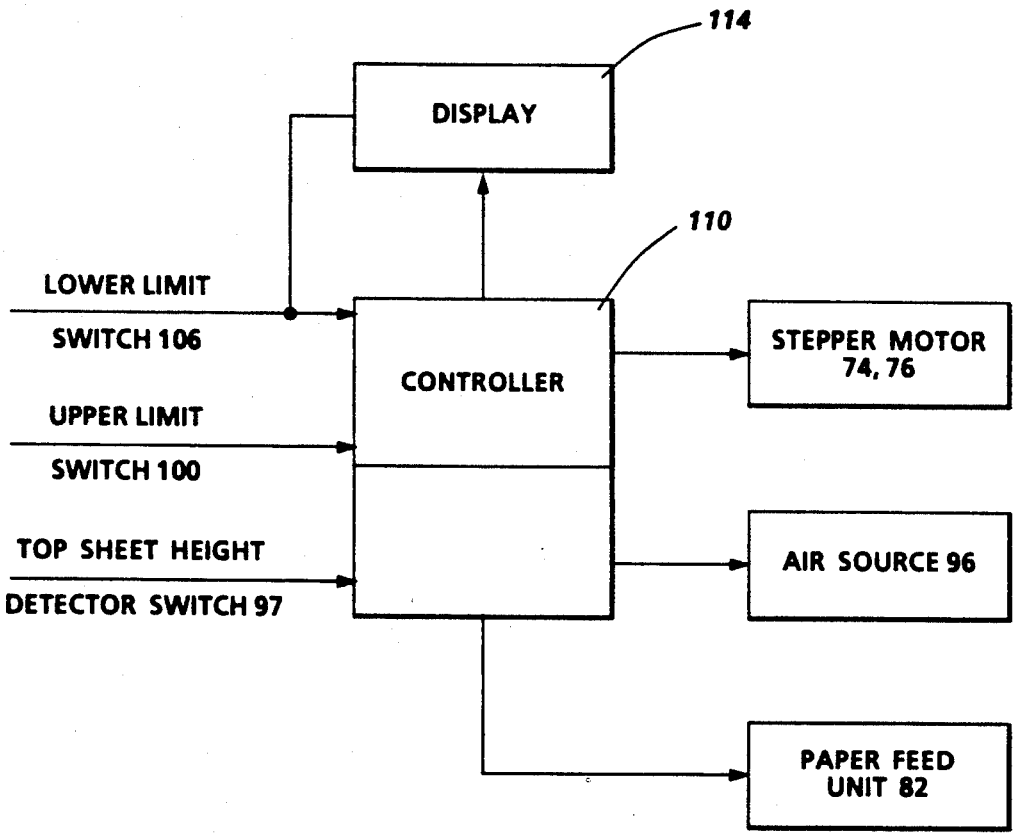
FIG. 2 shows a control circuit for controlling the operation of the input/output apparatus.

The sheet bearing the fused toner image then passes through decurler 54 and forwarding rollers 56, thence to be deposited on the surface of the stack tray 80 and forming the bottom sheet of what will become output stack 64'. The height sensitive probe sensor 98 detects the feeding, of the top sheet from stack 64 and sends a signal to controller 110 (FIG. 2) which sends a stepping pulse to motors 74, 76 causing the rotating lead screws 71, 72 to drive in a direction and for a time interval, which causes tray 80 to descend an incremental distance determined by the thickness of copy sheet 29 to maintain copy sheet feeding unit 82 in position to feed the next sheet. Under continual control of controller 110, tray 80 is incrementally stepped downward and the top most sheets from stack 64 are successively inputted into the transfer station. The leading edge of each sheet proceeds through baffle 91 and is engaged by roller pair 94 bringing the sheet into contact with transport belt 104. Belt 104 moves slightly faster than the roller pair 94 rotation to ensure that a buckle does not form at the interface. Roll sensor 93 is positioned to detect misfeed or jam at the feeder/vacuum transport interface, and send appropriate signals to controller 110.

Figure 4:
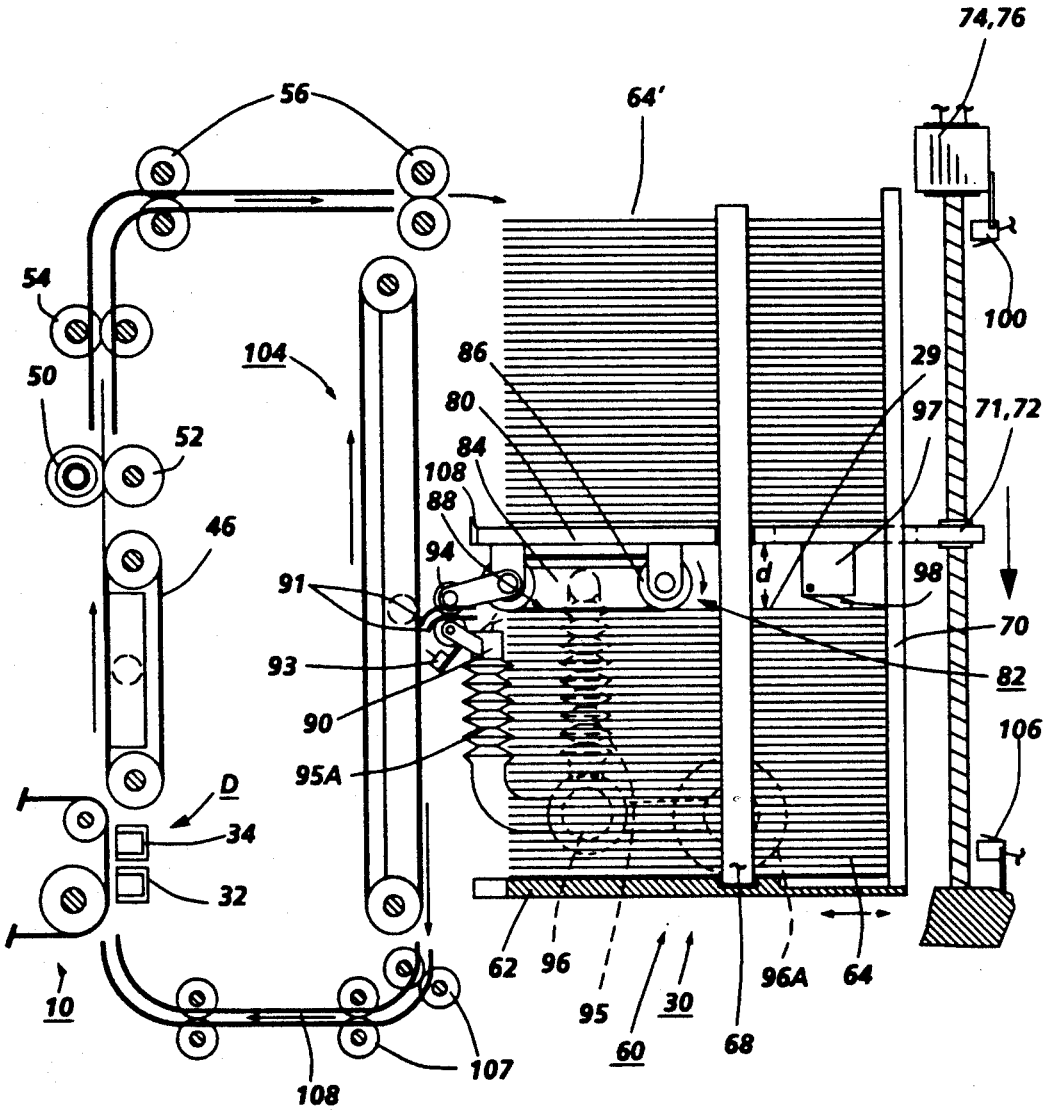
FIG. 4 is a view of the input/output apparatus of FIG. 1 with approximately ½ of the copy sheets being fed and stacked.
Figure 5:
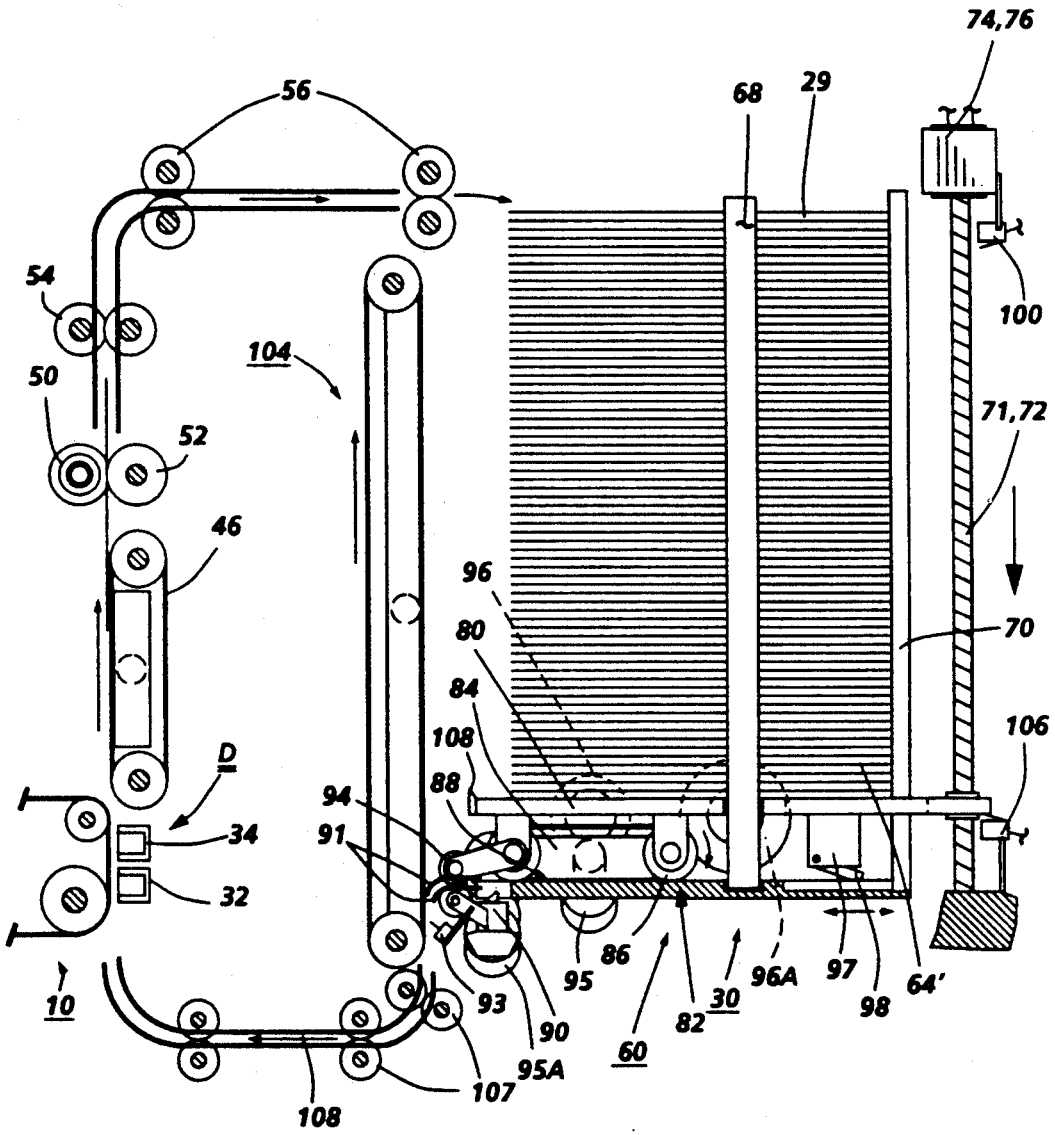
FIG. 5 is a view of the input/output apparatus of FIG. 1 after all of the copy sheets have been fed and stacked.
Figure 6:
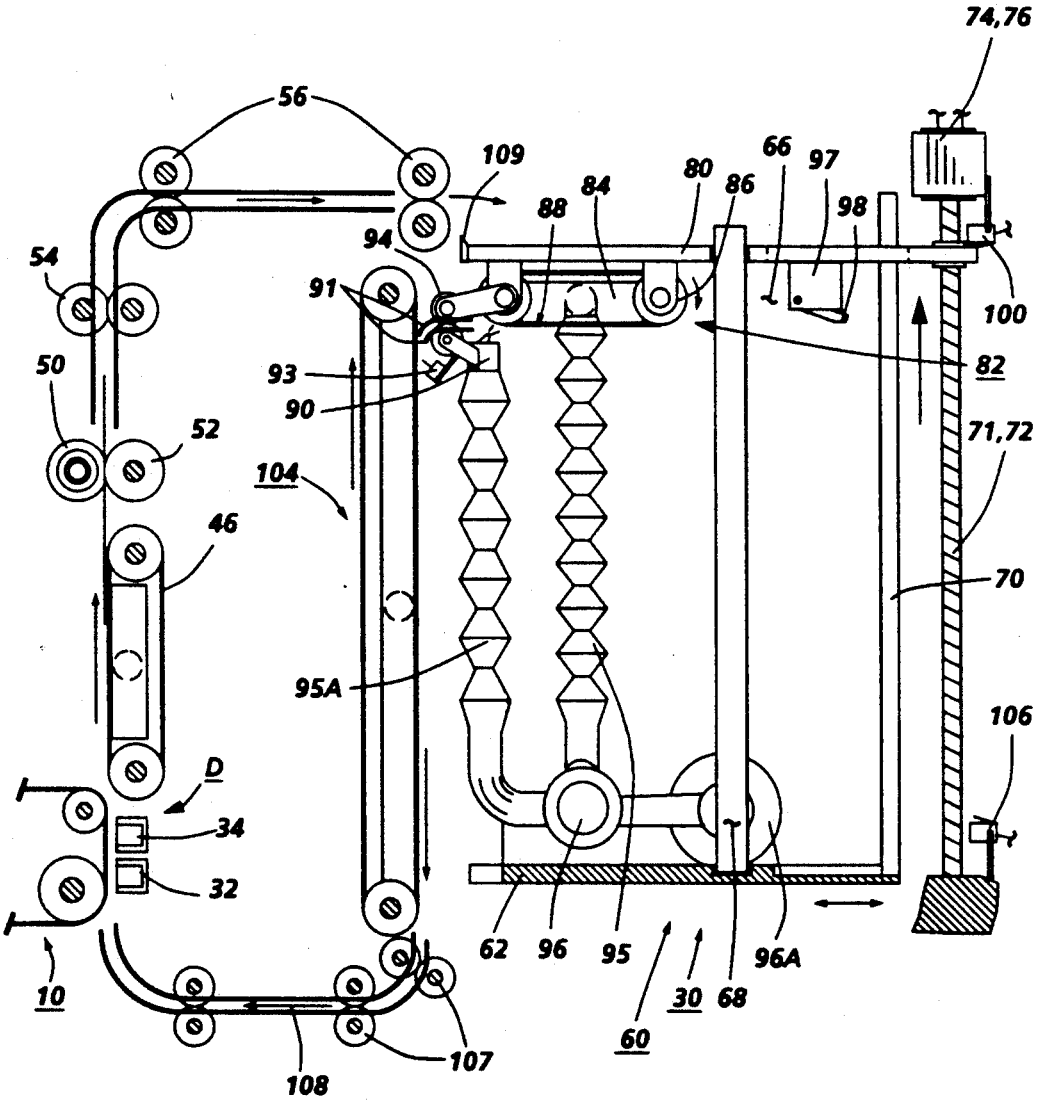
FIG. 6 is a view of the input/output apparatus of FIG. 1 in a position ready to be reloaded with copy sheets.

Input/output apparatus 30, as shown in FIGS. 1 and 3, is in a fully loaded condition; that is, the entire operational space bounded by the bottom surface 62, fixed wall 66, guides 68, 70, and a horizontal plane through the initial position of stacker tray 80 is filled with a stack 64 of copy sheets 29 waiting to be fed into the processing areas (transfer, fusing) of machine 8. This feature enables a very high capacity paper supply compared to conventional input stations. In a preferred embodiment 12 reams of #20 paper stacked to a vertical height of 24" can be used. As will be seen, while the sheet operational space remains constant, it will be occupied by differing quantities of copy sheets waiting to be fed and copy sheets which have been processed. FIG. 4 shows apparatus 30 at a point approximately midway through a copy cycle where the copy sheet input stack 64 has been partially depleted, but where copy sheet output stack 64' has been formed. Stacks 64 and 64' can be considered to be waning and waxing respectively during operation. FIG. 5 shows the condition of apparatus 30 at the end of the copy/feed cycle when stack 64 has disappeared (been depleted) leaving stack 64' occupying the same volume originally filled by stack 64 shown in FIG. 3. Thus, in comparing FIGS. 3, 4, and 5, it is apparent that an object of the present invention, to optimize the copy sheet feeding and stacking, has been achieved by utilizing a fixed space defined in a single apparatus to accommodate both input and output copy sheet functions.

Figure 7:
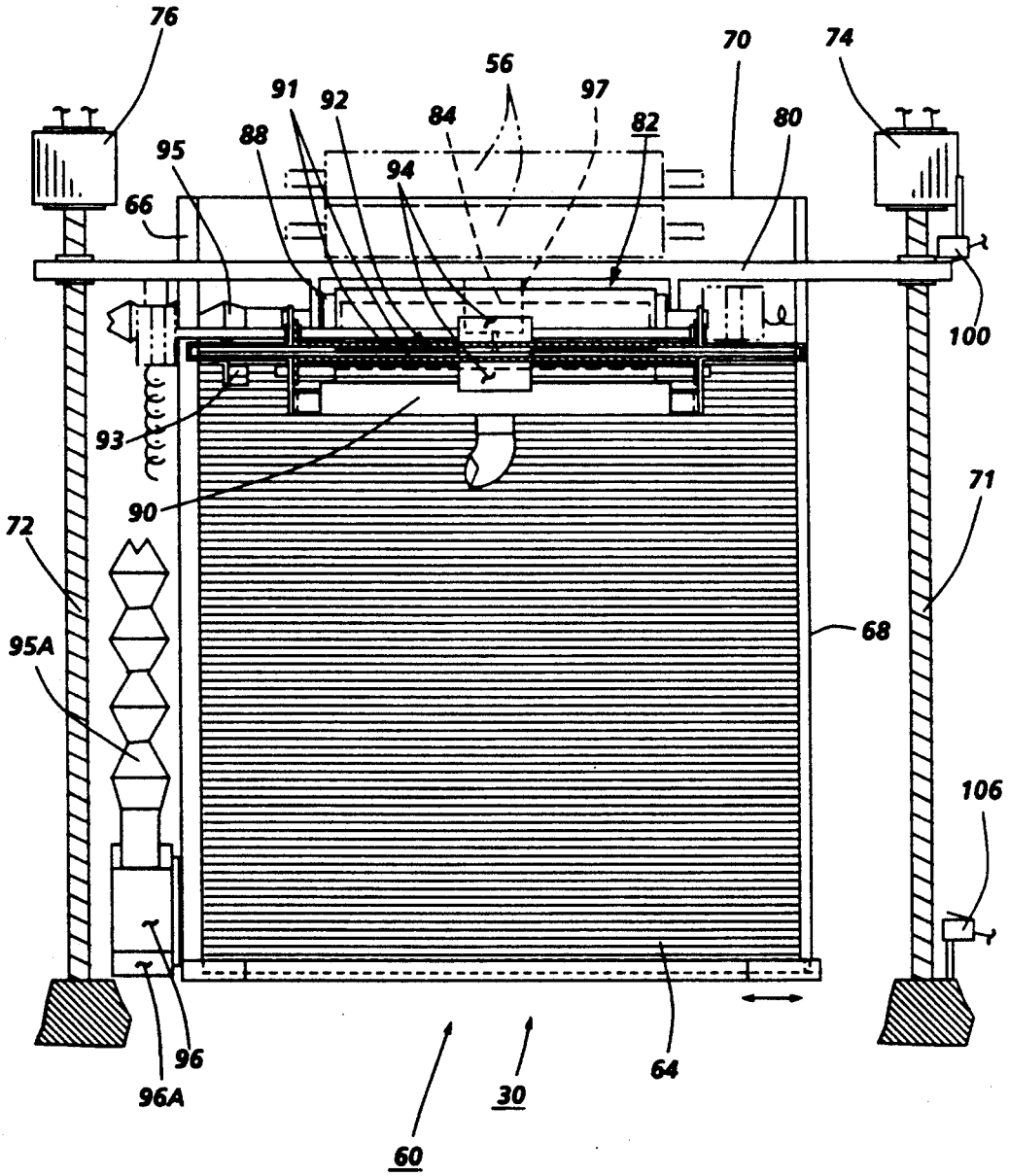
FIG. 7 is a front view of the input/output apparatus of FIG. 3.

Operation of the input/output apparatus 30, from a fully loaded to a fully depleted condition, will now be described. Referring firstly to FIGS. 1, 3, and 7, it is assumed that copy stack 64 has been loaded into position and guides 68, 70 adjusted to accommodate for the size of the copy sheets 29. Guide 68, 70, as will be seen, serve as guides for both the input and output copy sheets. It is further assumed that machine 8, under control of controller 110 has enabled the exposure and development processing stations of machine 8 and that developed images on belt 10 are to be transferred to copy sheets 29 at transfer station D. Paper feed unit 82 and air source supply 96A are activated by signals from the controller. The top copy sheet from stack 64 is held in flat orientation against plenum 84 and is moved from right to left (FIG. 3) by action of feed roller 86 and feed belt 88. Air knife 90 detaches the leading edge of the top sheet from the next underlying sheet The sheet is moved through the transfer and fusing stations as described above. FIG. 4 shows apparatus 30 after approximately ½ of the sheets from initial stack 64 have been fed and then returned, after processing, into output stack 64'. As is seen, tray 80 has been indexed downward by successive lead screws 71, 72, incremental rotations carrying paper feed unit 82 to the position shown. It is apparent that unit 82 acts as a variable position vacuum transport; paper fed from the unit can be engaged at any point along the vertical surface of transport belt 104.

It is also noted that the input and output (feed and return stacks) sections of apparatus 30 are functionally independent of copy sheet weight and copy sheet thickness characteristics; e.g. a thicker copy sheet will increment the feed unit 80 downward at a faster rate than a thinner sheet but the stacker tray 80 will also move downward at a correspondingly faster rate 80 so that there is always the same distance, d, as shown.

With continued operation, input stack 64 will finally become exhausted as shown in FIG. 5 and output stack 64' is at maximum. At this point, stacker tray 80 engages lower limit switch 106, sending a display to the machine control panel 114 alerting an operator and deactivating stepper motors 74, 76. Controller 110 also stops machine operation until the copy sheet input supply is replenished. At this point, the operator will open the front door, and remove the copy sheet output stack 64'. In a preferred embodiment, a sensor 109, fixed in position on tray 80, detects that the tray is empty (stack 64' has been removed). Upon closing of the door, removing an inhibiting interlock, motors 74, 76 are energized to drive the screws 71, 72 in an opposite, return direction rapidly returning tray 80 to the position originally established in FIGS. 1, 3. The tray motion stops when upper limit switch 100 is contacted and energized. The tray 80 thus operates at two speeds, slow (index down) and a fast (return up). Upon return of tray 80 to the top position, the forming a new stack 64, the operator can then open the door and reload copy sheets onto floor 62, forming a new stack 64, close the door and resume machine operation.

From the above operational description, it is seen that a most efficient copy sheet input/output operation is enabled. The total volume of the housing available for copy sheet input and output operation is always almost completely filled with copy sheets either waiting to be fed (stack 64) or outputted into stack 64'. There is no "air space"; hence the apparatus is very compact lending itself to a more compact total machine architecture.

While the invention has been described with reference to the structure disclosed, it will be appreciated that numerous changes and modifications are likely to occur to those skilled in the art, and it is intended to cover all changes and modifications which fall within the true spirit and scope of the invention.

We claim:

1. An apparatus for feeding sheets of paper from a loading station into a processing station, and from the processing station into a sheet receiving station the loading station including:

a fixed surface for supporting a supply of copy sheets to be fed, means for feeding successive sheets from the top of said paper supply into said processing station, and means for incrementally lowering said paper feeding means during said paper feed operation, and wherein said sheet receiving station includes a sheet stacker tray overlying said sheet loading station, said sheets being outputted to said stacker tray from said processing station and wherein said sheet feeding means is attached to the bottom of said sheet stacker tray.

2. The apparatus of claim 1 wherein said sheet stacking tray is separated by a distance d from the top sheet supplied on said copy sheet supply, said distance d being constant irrespective of the thickness of the sheets being fed.

3. An improved electrophotographic printing machine of the type in which a latent image is developed on a photoconductive member and a developed image transferred to a copy sheet and the developed image fixed at a fusing station, with successive copy sheets being supplied to said transfer station from a sheet loading station and exiting said fuser station into a sheet stacking station, whereby the improvement includes:

a first, fixed horizontal surface for supporting the copy sheets being supplied to said transfer station and a second, horizontal surface overlying said fixed surface for separating the sheets being supplied from the transfer station to the sheet loading station, said second surface being vertically movable with respect to said first surface.

4. The printing machine of claim 3 further including sheet feeding means located beneath said second horizontal surface and adapted to feed individual sheets from the top sheet of said sheet loading station.

5. An input/output apparatus for feeding copy sheets into the transfer station of an electrophotographic printing machine and for receiving and stacking the copy sheets as they exit the fuser station of said printing machine, said apparatus comprising:

a housing including at least a fixed bottom surface and a vertical side wall, said bottom surface forming the supporting surface for a supply of sheets to be fed into said transfer station, a second vertically variable support surface for supporting copy sheets exiting the fuser station, and means for varying the horizontal location of said second surface in response to the quantity of said sheets to be fed into said transfer station.

6. An apparatus for feeding sheets of paper into a processing station along a paper path length, the apparatus including:

a fixed horizontal surface for supporting a supply of copy sheets to be fed, a fixed vertical vacuum transport belt in operative relationship with said horizontal copy sheet support surface to transport copy sheets into said processing station, means for feeding successive sheets in the top of said paper supply into vacuum transport engagement with said transport belt, and means for incrementally lowering said paper feeding means during said paper feed operation so as to engage successive copy sheets at different locations of said transport belt while said paper path length continually varies during said paper feed operation.

* * * * *